United States Patent [19]

Lamport et al.

[11] Patent Number: 4,853,587

[45] Date of Patent: Aug. 1, 1989

[54] FLAT CATHODE RAY DISPLAY TUBE WITH PERIODIC BEAM REFOCUSING MEANS

[75] Inventors: Daphne L. Lamport, Godstone; Alfred W. Woodhead, Caterham, both of England

[73] Assignee: U.S. Philips Corporation, New York, N.Y.

[21] Appl. No.: 158,524

[22] Filed: Feb. 22, 1988

[30] Foreign Application Priority Data

Mar. 2, 1987 [GB] United Kingdom ..... 8704809

[51] Int. Cl.[4] ..... H01J 29/62; H01J 29/70

[52] U.S. Cl. ..... 313/422; 313/414; 313/460

[58] Field of Search ..... 313/422, 414, 449, 450, 313/452, 458, 460

[56] References Cited

U.S. PATENT DOCUMENTS

| | | | |
|---|---|---|---|
| 2,795,731 | 6/1957 | Aiken | 315/21 |
| 2,926,274 | 2/1960 | Gabor | 313/77 |
| 3,171,056 | 2/1965 | Gabor | 313/422 X |
| 3,683,224 | 8/1972 | Lea | 313/78 |
| 4,137,486 | 1/1979 | Schwartz | 315/366 |
| 4,698,555 | 10/1987 | Knapp et al. | 313/422 X |

FOREIGN PATENT DOCUMENTS

| | | |
|---|---|---|
| 0974093 | 11/1964 | United Kingdom . |
| 2059678 | 4/1981 | United Kingdom . |
| 2061613 | 5/1981 | United Kingdom . |

*Primary Examiner*—Kenneth Wieder

*Attorney, Agent, or Firm*—Robert J. Kraus

[57] ABSTRACT

The display tube includes an electron gun (29) which directs a low energy electron beam (30) generally parallel to a flat faceplate (14) carrying a phosphor screen (16). The beam is deflected in a plane parallel to the faceplate by deflection electrodes (38) for line scanning purposes before being reversed in direction by a reversing lens (40) and then scanned framewise over the input side of an electron multiplier (44) by further deflection electrodes (42). The low energy beam in the scanning section of the tube is susceptible to the influence of ambient magnetic fields. The ensure that the beam correctly enters the reversing lens (40) in its acceptance window regardless of such fields an electron-optic lens system (50) defining a series of alternate high and low voltage regions and constituting in effect a series of relay lenses is provided between the gun and the reversing lens which periodically re-focusses the beam and constrains the beam substantially along a predetermining path with respect to the reversing lens.

13 Claims, 3 Drawing Sheets

FLAT CATHODE RAY DISPLAY TUBE WITH PERIODIC BEAM REFOCUSING MEANS

BACKGROUND OF THE INVENTION

This invention relates to a flat cathode ray display tube comprising an envelope including a substantially flat, transparent, faceplate carrying a phosphor screen, means for producing an electron beam and directing the beam parallel to the faceplate through a first region towards a reversing lens which turns the beam so that it travels in substantially the opposite direction parallel to the faceplate through a second region, first deflection means adjacent the output of the electron beam producing means for deflecting the beam substantially in a plane parallel to the faceplate and second deflection means in the second region for deflecting the electron beam toward the screen.

A flat cathode ray display tube of this kind is described in British Patent Specification 2101396. In this tube, the envelope consists of a shallow, generally rectangular, metal can with a flat glass faceplate, constituting the display window, mounted on the can. An electron gun in the rear region of the envelope produces a low energy electron beam which is deflected to effect line scanning by an adjacent electrostatic deflection arrangement before passing to the reversing lens. After having been reversed in direction through 180 degrees, the beam undergoes field scanning by means of a plurality of selectively energised, electrodes arranged in a plane parallel with the faceplate in the front region of the envelope and is deflected thereby towards a phosphor screen carried on the faceplate onto the input side of a channel electron multiplier disposed parallel to, but spaced from, the screen. Thus, the line and field scanned beam provides a raster scanning electron input to the electron multiplier. Having undergone current multiplication within the electron multiplier, the electron beam is accelerated onto the phosphor screen by means of a high voltage field established between a backing electrode on the screen and the output side of the electron multiplier to produce a raster-scanned display picture.

An advantage in using an electron multiplier in this manner is that the multiplier in effect separates the scanning function of the electron beam from the light-generating process. The electron beam, prior to reaching the multiplier, need only be of low energy so that the beam forming and raster scanning section of the tube operates at low voltage and current compared with the high voltage, higher current screen output section. The term "low energy" used herein is intended to signify an electron beam of less than 2.5 KeV and typically several hundred electron volts. For example, a low voltage, low current beam having an acceleration voltage of around 400 V may be used. The electron multiplier amplifies the beam current and the amplified current beam, is accelerated across a short gap to the screen to produce the power necessary to generate the light output. The low energy and low current electron beam used in the beam forming and raster scanning section of the tube can easily be deflected through large angles without undue enlargement of the spot. This enables the kind of folded electron optical system described to be employed with the result that a comparatively compact, and shallow, display tube is obtained.

As a result, however, of the use of a low energy electron beam in the beam forming and raster scanning section of the tube and the long trajectory of the beam in that section, the tube is more sensitive to ambient magnetic fields, for example the Earth's magnetic field, than a conventional display tube using a high voltage beam. The low energy beam is more easily disturbed and ambient magnetic fields penetrating the first region of the tube can influence the direction and position of the beam before it reaches the reversing lens producing a deviation from the intended path of the beam through the reversing lens. If it fails to enter the reversing lens within the lens' acceptance window a total loss of picture can result.

The metal can of the tube's envelope affords some magnetic shielding. In addition, an external magnetic shield comprising a box of mumetal material can be fitted around the tube's envelope, to reduce the effects of extraneous magnetic fields. However, the use of a shielding box is expensive and adds to the bulkiness and weight of the tube, causing further complications, and is not always practical.

SUMMARY OF THE INVENTION

It is an object of the present invention to provide a more effective way of at least significantly reducing the undesired effects on the operation of a cathode ray display tube of the kind mentioned in the opening paragraph caused by external magnetic fields to ensure that the electron beam acceptably enters the reversing lens within its design tolerances.

According to the present invention therefore, a flat cathode ray display tube of the kind mentioned in the opening paragraph is characterised in that the tube includes an electron-optic lens system defining a beam control region located between the electron beam producing means and the reversing lens which operates to refocus the beam periodically in that region and to constrain the beam substantially along a predetermined path.

It will be appreciated that in the beam control region the electron beam is continually undergoing scanning as a result of the action of the first deflection means and therefore the term "electron beam path" should be construed accordingly.

The electron-optic lens system, by virtue of its action in periodically re-focussing the electron beam can be regarded in effect as a series of relay lenses.

With the predetermined path suitably chosen, the lens system of the invention ensures that the electron beam enters the reversing lens substantially in the correct position relative to the reversing lens configuration by directing the beam along a certain portion of the region between the beam producing means and the reversing lens while deflection of the beam in a plane substantially parallel to the faceplate continues in that region for line scanning purposes. It has been found that by using a lens system in this manner, the position of the electron beam as it enters the reversing lens is unaffected by external magnetic fields of magnitude at least five times greater than the earth's magnetic field. Thus the invention is capable of providing protection not just from the effects of the Earth's magnetic field but also from much stronger magnetic influences enabling the possibility of the tube being used in more severe magnetic environments without operational performance suffering as a consequence.

The lens system may be magnetic or electrostatic. In a preferred embodiment however the lens system is a series of electrostatic relay lenses comprising electrodes arranged on opposite sides of the electron beam path and extending in the beam deflection direction and substantially parallel to the plane of the faceplate which are arranged to provide a series of regions alternately at high and low voltages relative to one another in said beam control region. As deflection (line scanning) of the beam by the first deflection means, is also in a plane parallel to the faceplate, control of the beam at any point in the deflection is achieved as a result of the electrodes extending in the deflection direction.

The electrodes providing the low voltage field regions may comprise a plurality of spaced pairs of strip-shape electrodes extending generally parallel to one another, the electrodes of each pair being arranged on opposite sides of the beam deflection plane. Respective electrodes of the pairs of electrodes on opposite sides of the beam deflection plane preferably lie in respective planes substantially parallel to the faceplate. Advantageously, the electrodes of each pair of electrodes, in use, are at the same potential and are arranged symmetrically with respect to the deflection plane. Thus, the electron beam path lies in a plane mid-way between the series of low voltage electrodes. This plane is aligned approximately with the centre of the acceptance window of the entrance of the reversing lens.

The electrodes providing the high voltage regions may comprise an opposed pair of electrodes extending substantially parallel to one another and the electron beam deflection plane along the length of said control region and arranged further away from the electron beam then the electrodes providing the low voltage regions. In this case, one of the pair of high voltage electrodes may conveniently be carried on the rear surface, i.e. the surface remote from the faceplate, of a partition separating the envelope into front and rear regions (the second and first regions respectively) and carrying also the second deflection means. The other of the pair of high voltage electrodes may be carried on the rear wall of the envelope, or may even be constituted by the rear wall itself, this rear wall of the envelope being generally flat and lying in a plane substantially parallel to the faceplate and the aforementioned beam deflection plane. Preferably, the pair of high voltage electrodes, in use, form equipotential planes and are arranged symmetrically with respect to the deflection plane.

Alternatively, the electrodes providing the high voltage regions may comprise a pluraltiy of spaced pairs of strip shape electrodes, each pair of electrodes extending substantially parallel to the deflection plane, and arranged alternately with the low voltage electrode pairs, with the electrodes of each pair being arranged on opposite sides of the deflection plane. For ease of construction, the respective electrodes of both the high and the low voltage electrodes on opposite sides of the deflection plane are preferably co-planar. The electrodes may, in this case, be provided by co-planar strips of conductive material screen printed or evaporated, for example, onto respective common insulative supporting sheets, for example of glass. This structure has the advantage that the relative positions of the electrodes providing high and low voltage regions can be readily determined at the manufacture stage and the position of the electrodes with respect to the beam deflection plane accurately defined during assembly of the tube by appropriate location of the supporting sheets. Moreover, the locations of these supporting sheets can be controlled to some extent if necessary to take account of small deviations in the orientation of the electron beam producing means during assembly.

In order to ensure optimum beneificial effects, the voltages applied to the series of electrodes should be varied in accordance with deflection of the electron beam by the first deflecting means. Thus, the voltages may be varied at line scan rate. The first deflection means deflects the beam about a centre line of symmetry corresponding to the path for an undeflected beam. The deflection may be for example, 26 degrees on either side of this centre line, giving a total deflection angle of 52 degrees. As the beam is being deflected, therefore, its velocity component in the direction of the centre line varies and reaches a maximum reduction at the outer extremities of the deflection pattern. By varying the voltages applied to the electrodes this variation can be accommodated and the beam caused to emerge from the control region for entry into the reversing lens in the correct manner rather than in a divergent or convergent mode.

Preferably the voltage applied to the electrodes providing the high voltage regions are maintained substantially constant and the voltage applied to the electrodes providing the low voltage regions is varied in accordance with beam deflection.

BRIEF DESCRIPTION OF THE DRAWINGS

A flat cathode ray display tube in accordance with the present invention will now be described, by way of example, with reference to the accompanying drawing, in which.

DESCRIPTION OF THE PREFERRED EMBODIMENTS

Figure 1:
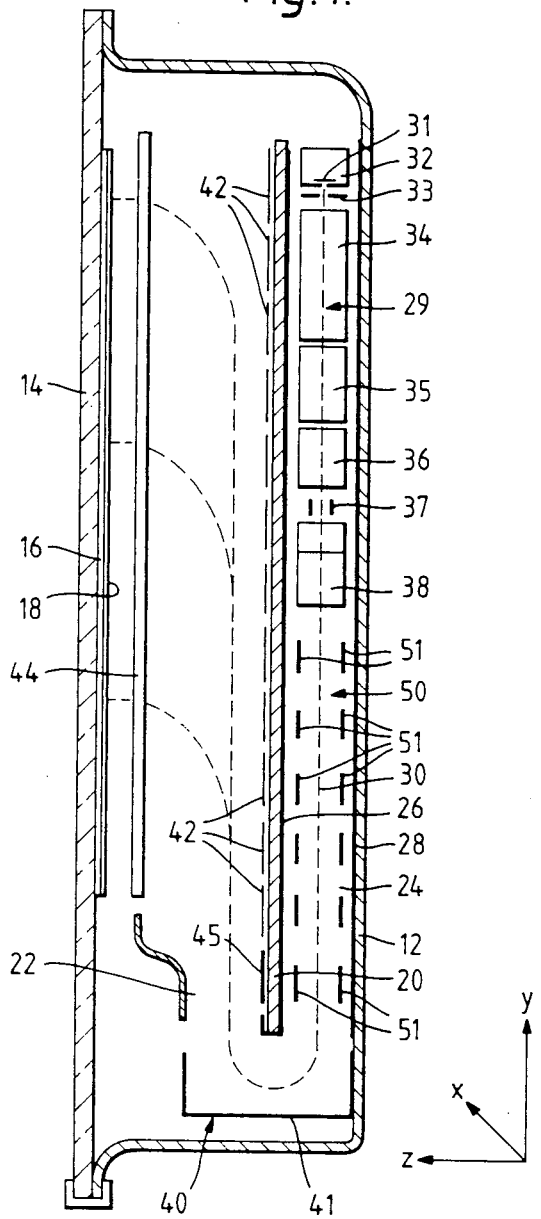
FIG. 1 is a diagrammatic perspective, partly cutaway, view from the rear of a cathode ray display tube according to the invention and showing the principle components of the display tube and one embodiment of a beam controlling electron-optic lens system in the rear region of the tube, between an electron gun and beam reversing lens of the tube.
Figure 2:
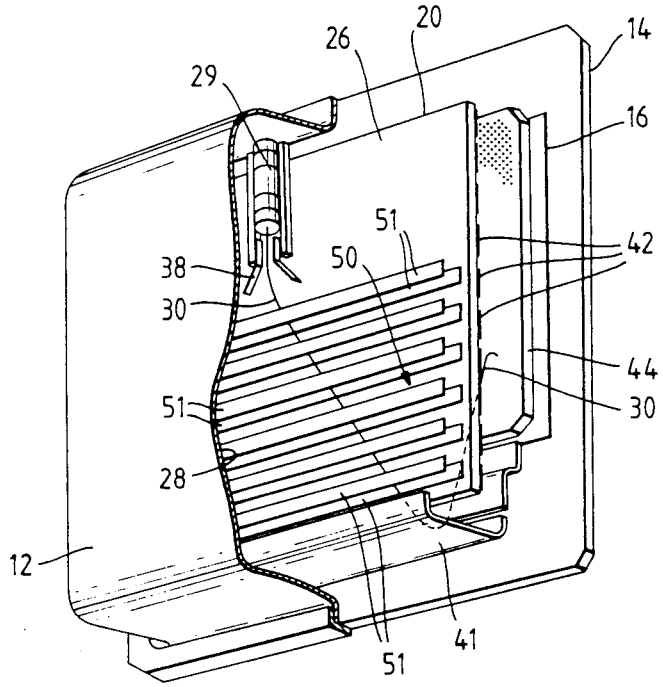
FIG. 2 is a diagrammatic cross-section through the display tube of FIG. 1.

Referring to FIGS. 1 and 2, the cathode ray display tube comprises a generally flat-walled rectangular envelope 12 including a substantially flat, glass faceplate 14, the remaining walls being formed of metal, for example, mild steel. Carried on the inside surface of the faceplate 14, there is a screen comprising a layer 16 of phosphor material covered by an aluminium backing electrode 18.

The interior of the envelope 12 is divided in a plane parallel to the faceplate 14 by an internal partition 20 to form a front region 22 and a rear region 24. The partition 20, which comprises an insulator such as glass, extends over a major part of the height of the tube.

A planar electrode 26 is provided on a rear side of the partition 20. This electrode 26 extends over the lower, exposed, edge of the partition and continues for a short distance up its front side. Carried on the inside of the rear wall of the envelope is a planar electrode 28 corresponding to the electrode 26. The electrode 28 may be insulated from the rear wall.

Means for producing a low-energy electron beam is situated in the rear region 24. The electron beam producing means is arranged to direct an electron beam 30 downwardly of the tube parallel to the faceplate 14 and comprises an electron gun 29 having a heated cathode 31, an apertured grid electrode 32, an object forming apertured grid electrode 33, an acceleration electrode 34, a focussing electrode 35 and a final acceleration (anode) electrode 36.

A downwardly directed electrostatic line deflector 38 is spaced by a short distance from the final anode 36 of the electron gun and is arranged coaxially therewith. In operation, the line deflector 38 deflects the beam 30 in a plane parallel with the faceplate 14 to effect line scanning. Situated between the final anode 36 and the line deflector 38 are a pair of alignment electrodes 37, one on each side of the beam path.

At the lower end of the envelope 12, there is a reversing (mirror) lens 40 comprising a trough-like electrode 41 which is spaced below, and disposed symmetrically with respect to, the lower edge of the partition 20 and insulated from the envelope 12. By maintaining a potential difference between the electrodes 26 and 41 the electron beam 30 is reversed through 180 degrees so as to travel in the opposite direction in the front region 22 over the front side of the partition 20 whilst continuing along the same angular path from the line deflector 38.

On the front side of the partition 20 there is provided a planar deflection electrode arrangement. This arrangement comprises a plurality of laterally elongate, vertically spaced electrodes of which the lowermost electrode 45 may be narrower and acts as a correction electrode as will be described. The other electrodes, 42, are selectively energized to provide frame deflection of the electron beam 30 onto the input side of a channel plate electron multiplier 44 extending parallel to, and spaced from, the screen 16. The multiplier 44 has a matrix of channels of, say, 0.5 mm pitch and comprises a laminated metal dynode electron multiplier. Other forms of channel plate electron multipliers, such as a glass micro-channel plate electron multiplier, may be used instead. The electron beam, having undergone current multiplication within the multiplier 44, is then accelerated onto the phosphor screen 16 to produce a display by means of a high voltage accelerating field established between the screen electrode 18 and the output surface of the multiplier 44.

In operation of the display tube, the following voltages are, for example, applied with respect to the cathode 31 potential of OV. The final anode 36 of the electron gun is held at 400 V giving an electron beam acceleration voltage of 400 V. The electrodes 26 and 28 in the rear region 24 are also held at 400 V whilst line deflection is accomplished by applying in regular fashion potential changes of about ±60 V around a mean of 400 V to the plates of the line deflector 38. The trough-like electrode 41 of the reversing lens is at OV, compared to the 400 V of the extension of the electrode 26 over the bottom edge of the partition 20, to reflect the beam 30 through 180 degrees. The input surface of the multiplier 44 is at 400 V whilst at the beginning of each frame scan the electrodes 42 are at 400 V, but are subsequently ramped down to OV in turn, so that the electron beam 30 in the front region 22 is initially deflected into the uppermost channels of the multiplier 44 and then progressively moves downwardly over the multiplier, the point of deflection being determined by the next electrode 42 in the array to be at OV. Using overlapping waveforms applied to the electrodes 42, vertical, frame, scanning is achieved smoothly.

The voltage across the multiplier is typically about 1500 V. The screen electrode 18 is typically at about 12 kV to provide the necessary acceleration for the beam from the multiplier output onto the phosphor screen 16.

It is seen therefore that the line deflector 38 and deflection electrodes 42 are responsible for scanning the low energy beam from the electron gun over the input surface of the multiplier 44 in raster fashion. In order to carry out a rectangular raster scan, it is necesary to provide a trapezium correction to the linescan by applying dynamically a correction to the line deflector 38. The electrode 41 is at a suitable distance from the partition's edge so that the beam, having been deflected through 180 degrees remains substantially parallel to the faceplate in the front region 22. As a precaution against misalignment however, which would lead to the beam 30 not emerging parallel to the plane of the screen, a correction voltage can be applied to the correction electrode 45 to adjust the exit angle.

In a similar manner, the pair of alignment electrodes 37 are provided for deflecting the path of the beam 30 in a plane perpendicular to the screen as it leaves the electron gun in order to counteract any misalignment of the gun and to ensure that, in ideal operating conditions, for example without any ambient magnetic fields, the beam path is substantially parallel with the screen 16 and enters the reversing lens at the optimum height.

The display tube described in British Patent Specification No. 2101396A, details of which are incorporated herein by reference. For a more detailed description of the operation of the tube, reference is invited to this specification.

In the event of the tube being subjected to ambient magnetic fields, unwanted deflection of the electron beam 30 can occur in the region 24. To simplify the following description it is assumed that the magnetic fields can have components Hx, Hy and Hz in x, y and z directions where x, y and z are, as shown in FIG. 1, mutually orthogonal axes extending respectively parallel to the line deflection direction and the screen 16, parallel to the axis of the electron gun and perpendicular to the x axis and the plane of the screen 16.

It is important to successful operation of the tube that on entry to the reversing lens the electron beam does not fall outside the central 15–20% region of the width of the gap between the partition 20 and the plane of the sidewall of the electrode 41 adjacent the rear wall of the envelope 12. If it does, then severe defocussing or even loss of picture can occur. In this respect, interaction between the Hx component and the y-velocity component of the electron beam tends to deflect it in the z-direction, that is, across the width of the aforementioned gap. The pair of alignment electrodes 37 may be utilised to counteract the result of this interaction to some extent but this would not prove practical if the field is changing rather than static and also would be of little use in a situation where the ambient field causes the plane of deflection of the beam in the region prior to the reversing lens to be skewed with respect to the faceplate.

In order to suppress the effects particularly of an Hx magnetic field component and eliminate, or at least reduce significantly the amount of shift to the beam in Z direction, the display tube is, in accordance with the invention, provided with an electron-optic lens system defining a beam control region located between the electron gun and the reversing lens 41 to which voltages are applied that act on the beam to periodically re-focus the beam along its trajectory through that region and to constrain the beam substantially along a predetermined path, bearing in mind that the beam is being scanned in this region, so that it enters the reversing lens 40 in the desired position.

Figure 3:
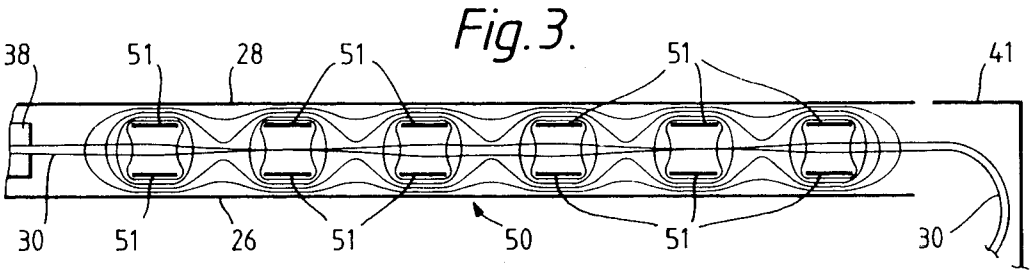
FIG. 3 is a diagrammatic cross-sectional view through the lens system of the tube of FIG. 1 illustrating its effect in operation of the tube on the electron beam in the beam control region between the electron gun and the reversing lens in the presence of an ambient magnetic field.

The lens system comprises an electrostatic series of relay lenses. Referring now also to FIG. 3, this series of relay lenses, indicated generally at 50, comprises electrodes disposed on opposite sides of the desired plane of deflection of the beam in the rear region of the tube, to which voltages are applied so as to form a series of alternate high and low voltage regions encountered by the beam which maintain the beam in a substantially central plane between the plane of the electrode 26 and the plane of the side wall of the trough electrode 41 near the rear wall of the envelope. The plane of beam deflection in the control region is thus constrained substantially parallel to the plane of the faceplate. The relay lenses continually re-focus the beam and in response to the effect of a magnetic field tending to displace the beam from the central plane return the beam to the central plane under the influence of the electric fields generated by the lenses, thus ensuring entry of the beam into the reversing lens 41 at the desired height.

Thus, the high and low voltage regions in effect provide field and focussing type lenses which act to maintain the beam in the desired plane. The relay lenses consist of two sets of electrodes, the first set comprising respective portions of the aforementioned electrodes 26 and 28 and the second set comprising a plurality of pairs of electrodes 51 spaced apart from one another in the tube's vertical direction and arranged one on each side, and symmetrically with respect to, the desired beam path. In this particular embodiment, six such pairs of electrodes are provided as the second set. The voltages applied to the electrodes of the first set, that is, electrodes 26 and 28, are the same so that equipotential planes are produced symmetrically of the desired beam path. The voltages applied to the electrodes of each pair 51 forming the second set are similarly the same, forming a series of spaced identical voltage strips symmetrically of the desired beam path, except that they are lower than the voltages applied to the first set. The resulting lines of equipotential of the fields produced by this arrangement are illustrated in FIG. 3. As can be seen, the beam 30 undergoes alternate convergent and divergent modes as it passes through the control region under the influence of the applied voltages and at the end of the region remains substantially symmetrical about the centre axis, corresponding to the desired beam path.

It is seen, therefore, that as the electron beam 30 travels in the control region it experiences alternately relatively high and low voltages whose action constrains the beam along the desired path to the reversing lens irrespective of the influence of an external magnetic field.

Figure 4:
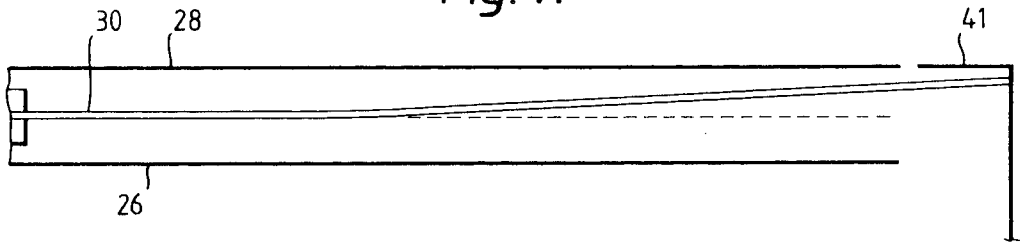
FIG. 4 is diagrammatic cross-sectional view through the beam controlling region of the tube, illustrating the effect of the ambient magnetic field on an electron beam in that region in the absence of the beam controlling lens system.

For comparison, FIG. 4 illustrates the affect of an external magnetic field equivalent to the strength of the horizontal component of the Earth's field acting perpendicular of the plane of the paper on the trajectory of the electron beam in the absence of the relay lens system, or more precisely in the absence of the second set of electrodes.

During operation of the tube, the line deflector 38 is arranged so as to repetitively and regularly deflect the beam from the electron gun in a plane parallel to the faceplate, this deflection being, for example, 26 degrees at the extremity to either side path of an undeflected beam, making a total deflection angle of 52 degrees.

The electrodes 26 and 28 extend completely over the area of this deflection pattern so that constraint of the beam along any path in its deflection pattern is achieved. The pairs of electrodes 51 comprise opposing elongate, strip-shape, electrodes extending parallel to the plane of electrodes 26 and 28, and hence the faceplate 14, and in a direction transverse to the undeflected beam path through this region so as again to cover the full deflection area. Since the beam deflection pattern is triangular, the pairs of electrodes 51 could progressively increase in length producing a fan-shaped array rather than all being of similar length or shape, whilst still covering the deflection area.

The velocity of the beam in the y direction (FIG. 1) will vary in accordance with the position of the beam in its deflection pattern and will be a maximum for an undeflected beam travelling vertically downwards and a minimum for a beam at either extremity. This change of velocity component needs to be taken into consideration as it has a bearing on the effect on the beam of the relay lens system. It is desirable for optimum operation of the tube that the beam does not enter the reversing lens in either a convergent or a divergent mode. In order to ensure this is the case, the voltages applied to the relay lens system are varied in accordance with beam deflection, that is, in accordance with line scan rate, so as to compensate for these variations in the y direction velocity component. More particularly, the voltages applied to the pair of electrodes 51 of the second set are varied while the higher voltages applied to the electrodes of the first set are maintained substantially constant.

Typical examples of applied voltages will now be described. For this purpose it is assumed that the final acceleration electrode potential of the gun 29 is 400 V, and that, the distance between the deflector 38 and reversing lens is approximately 14 cms, and that the second set of electrodes 51 comprise six pairs of 5 mm wide electrodes, on a 15 mm pitch. The voltage applied to the first set of electrodes, 26 and 28, is held at 400 V, and the voltage applied to the pairs of electrodes 51 is varied from 140 V for a beam at a scan angle of zero degrees (undeflected), through 160 V for a beam at a scan angle of 14 degrees, to 190 V for a beam at the extreme scan angle of 26 degrees.

The higher voltage is chosen here to be the same as the gun's final acceleration potential for convenience and to avoid the possibility of some lens action occuring at the beginning and end of the control region. Different higher voltage values could be used instead. The lower voltage value is dictated by the chosen higher voltage value, or vice versa.

The electrode 26 may be deposited as a layer of suitable material on the rear surface of the partition 20 or may alternatively comprise a sheet carried by the partition 20. The electrode 28 may be constituted by a portion of the rear wall of the envelope 12 or by a separate electrode sheet carried by the envelope and optionally also insulated therefrom.

The pairs of electrodes 51 may be carried by a suitable support structure (not shown) mounted on the envelope 12. The electrodes of each pair may be supported at their ends or may comprise for example, the arm portion of a U-shape strip which is mounted at its base. Moreover, the plurality of pairs of electrodes could be formed integrally by stamping from a common sheet.

Figure 5:
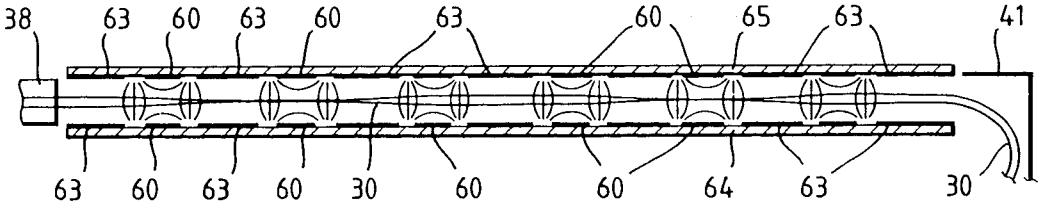
FIG. 5 is a diagrammatic cross-sectional view through an alternative embodiment of electron-optic lens system for use in the tube of FIG. 1 and, like FIG. 3, illustrating its effect in operation on the electron beam.

In order for the relay lens system to perform its required function reliably and most effectively, it is necessary for a high degree of accuracy to be achieved in the relative positioning of the electrodes 26, 28 and 51 with respect to each other and to the reversing lens. A slight misalignment of one of the electrodes of the pairs 51, for example, could produce unacceptable results. With regard to FIG. 5, another embodiment of a relay lens system for use in the display tube is shown which should help reduce the possibility of this kind of problem. Referring then to FIG. 5, it can be seen that instead of having separate strips placed between equipotential planes (26, 28) the required variation in potential in the beam path direction is provided by coplanar strips. The second, lower voltage region defining set of electrodes of the relay lens system in this case is formed of a number of pairs 60 of opposing electrodes, similar to the electrode 51 in the previous arrangement, spaced apart in the direction of beam travel and arranged alternately with the pairs 63 of opposing electrodes constituting the first, higher voltage region defining set of electrodes. As in the previous arrangement, the electrodes of each pair are arranged symmetrically about the desired electron beam path except that in this embodiment the respective electrodes of both sets of electrodes on each side of the beam path are coplanar and extend in the direction transverse to the beam path. Apartm from being wider, the electrodes of the pairs 63 are generally similar to electrode pairs 60, and thus electrode pairs 51 of the earlier embodiment, so far as their elongate nature and orientation are concerned. As before, the high and low voltages are applied respectively to the electrodes of the first and second sets to form a series of alternate high and low voltage regions constituting a series of relay lenses. Equipotential lines of the resultant fields are illustrated in FIG. 5 and, as can be seen, the effect on the electron beam of the resulting electric fields is much the same as shown in FIG. 3 with the beam being periodically re-focussed and constrained substantially along the desired path for entry into the reversing lens at the optimum height and without either convergence of divergence at that point.

This arrangement lends itself to a high degree of accuracy as all electrodes to one side of the beam path can be carried on a respective common support as indicated at 64 and 65. Conveniently, the electrodes comprise strips of metal screen printed or evaporated onto insulative sheets such as glass, with interconnections between the respective electrodes of both sets being formed simultaneously.

The supports 64 and 65 may be mounted on, respectively, the partition 20 and the rear wall of the envelope 12 or other parts of the envelope 12, either directly or indirectly.

The voltages necessary with this particular embodiment will be slightly different to those described earlier. As an example of the typical applied voltages during operation, the voltage of the electrodes of the first set, would be the same as before, that is 400 V and the voltage applied to the electrodes of the second set varied in accordance with electron beam deflection from 170 V for an undeflected beam to 215 V for a beam at the extreme deflection angle of 26 degrees.

We claim:

1. A flat cathode ray display tube comprising an envelope including a substantially flat, transparent, faceplate carrying a phosphor screen, means for producing an electron beam and directing the beam parallel to the faceplate through a first region towards a reversing lens which turns the beam so that it travels in substantially the opposite direction parallel to the faceplate through a second region, first deflection means adjacent the output of the electron beam producing means for deflecting the beam substantially in a plane parallel to the faceplate and second deflection means in the second region for deflecting the electron beam towards the screen, characterised in that the tube includes an electron-optic lens system defining a beam control region located between the electron beam producing means and the reversing lens which operates to refocus the beam periodically in that region and to constrain the beam substantially in said plane despite a beam-deflecting affect of an external magnetic field in which the tube is disposed.

2. A flat cathode ray display tube according to claim 1, characterised in that the electro-optic lens system comrpises electrodes arranged on opposite sides of the electron beam path and extending in the beam deflection direction and substantially parallel to the plane of the faceplate which are arranged to provide a series of regions alternately at high and low voltages relative to one another in said beam control region.

3. A flat cathode ray display tube according to claim 2, characterised in that the electrodes providing the low voltage regions comprise a plurality of spaced pairs of strip-shape electrodes extending substantially parallel to one another, the electrodes of each pair being arranged on opposite sides of the beam deflection plane.

4. A flat cathode ray display tube according to claim 3, characterised in that respective electrodes of the pairs of electrodes on opposite sides of the beam deflection plane and lie in respective planes which are substantially parallel to the faceplate.

5. A flat cathode ray display tube according to claim 4, characterised in that the electrodes of each pair of low voltage electrodes in use are at the same potential and are arranged symmetrically with respect to the beam deflection plane.

6. A flat cathode ray display tube according to any one of claims 2 to 5, characterised in that the electrodes providing the high voltage regions comprise an opposed pair of electrodes extending substantially parallel to one another and the electron beam deflection plane along the length of said control region and arranged further away from the electron beam then the electrodes providing the low voltage regions.

7. A flat cathode ray display tube according to claim 6, characterised in that one of the pair of high voltage electrodes is carried on the surface of a partition separating the envelope into the said first and second regions and which also carries the second deflection means.

8. A flat cathode ray display tube according to claim 6, characterised in that the pair of high voltage electrodes form equipotential planes and are arranged symmetrically with respect to the beam deflection plane.

9. A flat cathode ray display tube according to any one of claims 3 to 5, characterised in that the electrodes providing the high voltage regions comprise a plurality of spaced pairs of strip shape electrodes, each pair of electrodes extending substantially parallel to the deflection plane, and arranged alternately with the low voltage electrode pairs, with the electrodes of each pair being arranged on opposite sides of the deflection plane.

10. A flat cathode ray display tube according to claim 9, characterised in that the respective electrodes of both the high and low voltage electrode pairs on opposite sides of the deflection plane are co-planar.

11. A flat cathode ray display tube according to claim 10, characterised in that the respective electrodes of the low and high voltage electrode pairs on opposite sides of the deflection plane are carried on a common support.

12. A flat cathode ray display tube according to any one of claims 2 to 5, characterised in that the voltages applied to the series of relay lenses are varied in accordance with deflection of the electron beam by the first deflecting means.

13. A flat cathode ray display tube according to claim 2, characterised in that the electrodes providing high voltage regions are maintained at substantially constant voltage and the electrodes providing low voltage regions is varied in accordance with electron beam deflection.

* * * * *